US006652396B2

(12) United States Patent
McBride

(10) Patent No.: US 6,652,396 B2
(45) Date of Patent: Nov. 25, 2003

(54) NO-HANG BASKETBALL NET

(76) Inventor: Donald W. McBride, 1401 Johnson St., Johnston, IL (US) 62951

( * ) Notice: Subject to any disclaimer, the term of this patent is extended or adjusted under 35 U.S.C. 154(b) by 0 days.

(21) Appl. No.: 10/043,210

(22) Filed: Jan. 14, 2002

(65) Prior Publication Data

US 2002/0111235 A1 Aug. 15, 2002

Related U.S. Application Data

(60) Provisional application No. 60/267,712, filed on Feb. 12, 2001.

(51) Int. Cl.[7] ..... A63B 63/08
(52) U.S. Cl. ..... 473/485; 473/489
(58) Field of Search ..... 473/485, 449, 473/470, 447, 448, 472, 476, 489; 273/317.3

(56) References Cited

U.S. PATENT DOCUMENTS 1,218,204 A 3/1917 Ohlson
1,904,836 A * 4/1933 Peoples ..... 473/448
2,489,174 A 11/1949 Cunningham
4,300,764 A 11/1981 Burke
4,877,241 A 10/1989 Rothbard
5,330,199 A * 7/1994 Vand ..... 273/400
D351,880 S 10/1994 Taylor et al.
5,364,092 A * 11/1994 Riepe et al. ..... 473/448
5,458,325 A 10/1995 Klein et al.
5,692,979 A * 12/1997 Jones ..... 473/470
6,101,747 A * 8/2000 Myles ..... 36/136
D431,620 S 10/2000 Hill

* cited by examiner

*Primary Examiner*—Paul T. Sewell
*Assistant Examiner*—M. Chambers
(74) *Attorney, Agent, or Firm*—Richard C. Litman

(57) ABSTRACT

A basketball net, fabricated from a combination of elastic and non-elastic cords, is designed to be disposed substantially in the horizontal geometric plane defined by the basketball hoop. The no-hang feature of the net deters players from hanging and swinging from the net.

3 Claims, 2 Drawing Sheets

NO-HANG BASKETBALL NET

CROSS-REFERENCE TO RELATED APPLICATION

This application claims the benefit of U.S. Provisional Patent Application Ser. No. 60/267,712, filed Feb. 12, 2001.

BACKGROUND OF THE INVENTION

1. Field of the Invention

The present invention generally relates to sports equipment. More specifically, the present invention is drawn to a basketball goal designed to deter players from hanging from the net.

2. Description of Related Art

Most playground basketball courts are barren of traditional fabric nets due to the ever-present temptation of players to grab and hang onto the net which normally depends from fourteen to eighteen inches below the basketball hoop. In many instances, hanging and/or swinging on the net contributes to equipment destruction (torn nets, bent hoops, etc.). Often the nets are torn down only days after installation. Further, the players' fingers may become entangled in the net causing injury. Steel chain nets have been substituted for the traditional fabric nets, but their use has only exacerbated the above stated problems. Because of these factors, most public basketball facilities do not equip the goals with nets of any type. This situation is unfortunate in that the effect of a net greatly enhances the enjoyment of the game. A well-functioning net which would deter players from hanging therefrom would certainly be a welcome addition in the art.

The prior art is replete with patents which profess to improve the basketball goal. For example U.S. Pat. No. Des. 351,880 (Taylor et al.) shows a basketball return attachment utilized in lieu of a net.

U.S. Pat. No. Des. 431,620 (Hill) and U.S. Pat. No. 1,218,204 (Ohlson) disclose netless basketball goals.

U.S. Pat. No. 2,489,174 (Cunningham) shows an improved hoop support for a traditional basketball net.

U.S. Pat. No. 4,300,764 (Burke) provides for a shield made of heavy mesh metal to replace the traditional hoop and net. The shield is utilized to prevent players from dunking the basketball.

U.S. Pat. No. 4,877,241 (Rothberg) discloses a chain link basketball net.

U.S. Pat. No. 5,458,325 (Klein et al.) shows a basketball net made of steel cable.

None of the above inventions and patents, taken either singly or in combination, is seen to disclose a no-hang basketball net as will be subsequently described and claimed in the instant invention.

SUMMARY OF THE INVENTION

The present invention, to be dubbed "No-Hang Basketball Net", is a composite of soft, all-weather, basketball netting cords installed on a standard size basketball rim or hoop. The cords are of varying diameters and may be fabricated in elastic and non-elastic combinations, or they may be totally elastic. As contemplated, the netting is installed such that the cords are substantially within the horizontal geometric plane of the hoop. To prevent the net from rejecting the basketball, it has been determined that the netting should hang below the horizontal plane of the hoop no more than one and one-half inches. Since the net does not depend an appreciable distance below the hoop, the temptation to grab the net and hang or swing therefrom is reduced, in that players who can jump that high would probably grab the rim.

The net is designed with an inner circle having a circumference which is several inches smaller than the circumference of a standard basketball. The cord forming the inner circle is entirely elastic so that it is easily stretched to allow the basketball to pass therethrough. The weight of the basketball also functions to pull the outer cords downward before dropping through, giving a clear indication of a successful basketball shot with the accompanying "swish" and net movement that fans and players enjoy. The elasticity of the cords will cause the net to snap back to its original no-hang position substantially within the plane of the hoop.

Accordingly, it is a principal object of the invention to provide an improved net for a basketball goal.

It is another object of the invention to provide a net for a basketball goal, which net will deter a player from hanging therefrom.

It is a further object of the invention to provide an improved net for a basketball goal, which net retains the visible effects of conventional nets when the basketball passes therethrough.

Still another object of the invention is to provide an improved net for a basketball goal, which net is durable and easy to maintain.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
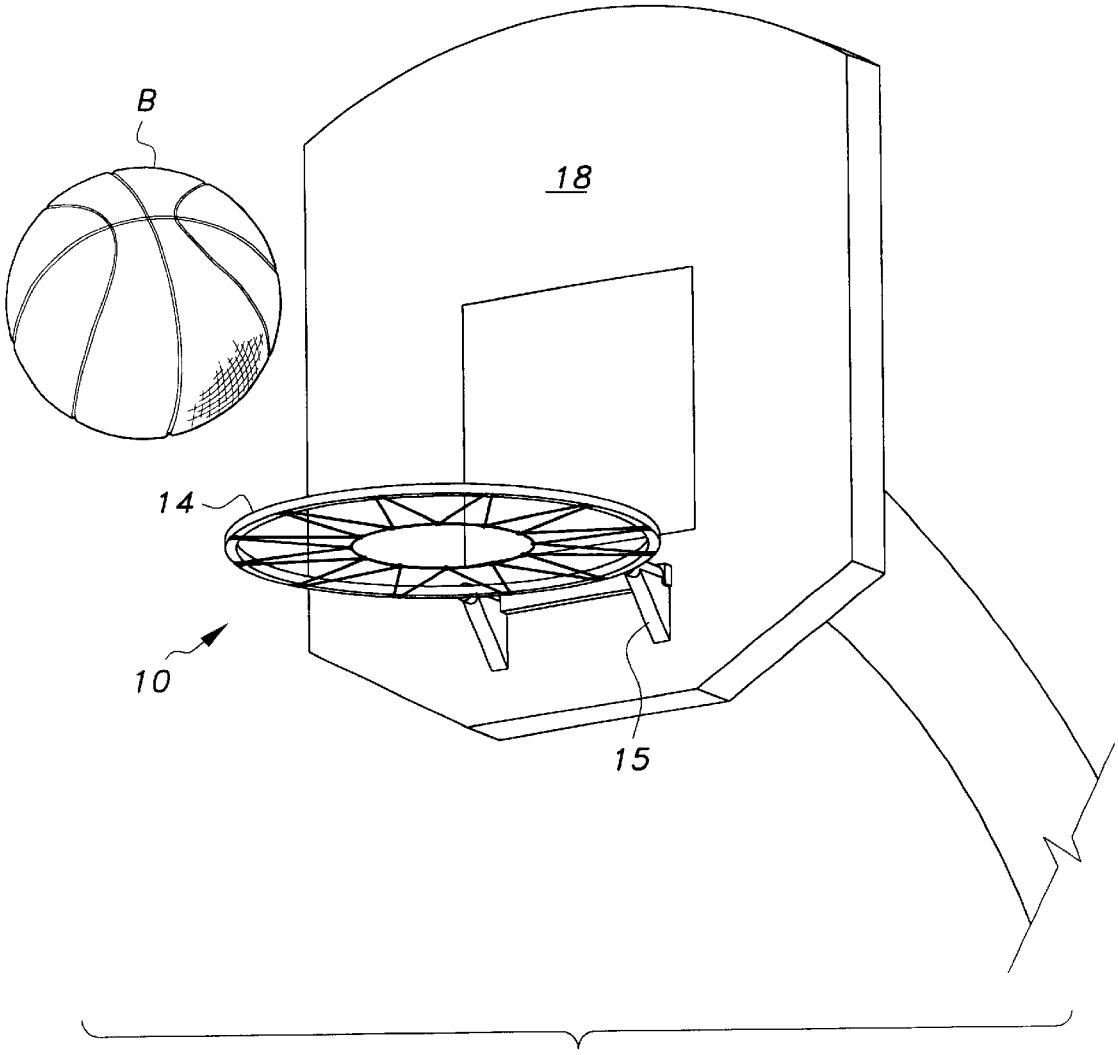
FIG. 1 is an environmental, perspective view of a no-hang basketball net according to the present invention.
Figure 2:
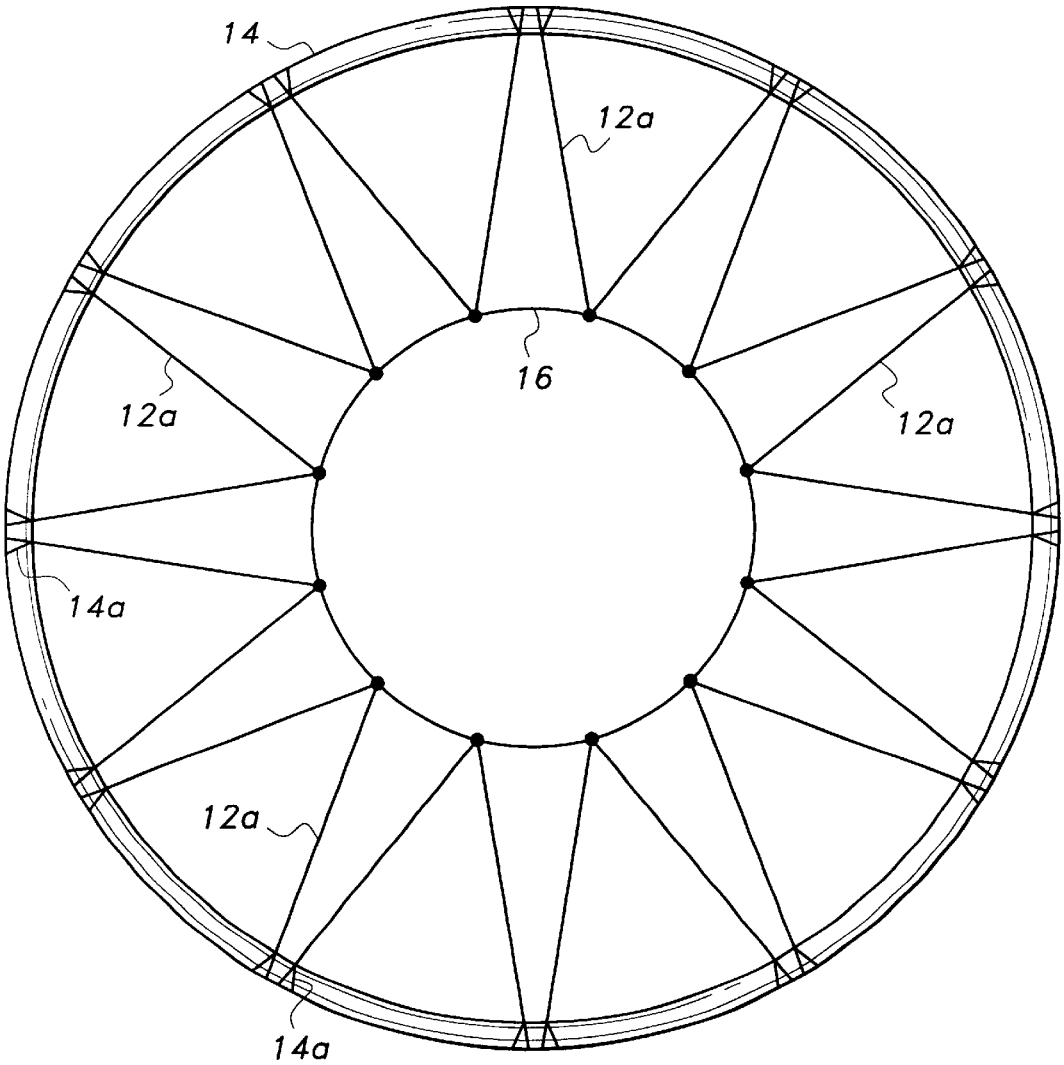
FIG. 2 is a top view of a no-hang basketball net according to the present invention.
Figure 3:
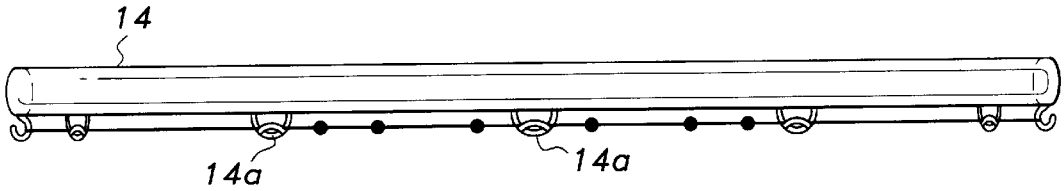
FIG. 3 is a side view of a no-hang basketball net according to the present invention.

As illustrated in FIGS. 1–3, the present invention is generally indicated at 10 and comprises a no-hang net mounted on a conventional basketball hoop 14. Hoop 14 is attached to a basket ball backboard 18 by conventional means 15. Basketball backboard 18 and basketball B are standard and are not part of the inventive concept per se. As best illustrated in FIGS. 2 and 3, the net is fabricated of a pre-determined combination of elastic and non-elastic outer cords 12*a*. However, all the outer cords 12*a* may be elastic if desired. Cords 12*a* are attached at their outer ends to hoop net hooks 14*a* in any efficient and convenient manner. The lengths and diameters of cords 12*a* may vary to the extent that the net will remain substantially in the horizontal plane defined by hoop 14 depending from the plane by no more than one and one-half inches. At their inner ends, cords 12*a* are attached to a circular cord 16. Cord 16 is fabricated from elastic material and, when installed, defines a circular opening having a diameter of approximately eight inches. Thus, the circular opening will have a circumference several inches less than that of the standard size basketball B.

As discussed above, since the net does not appreciably hang below the hoop, a player would have to jump to hoop height (ten feet) to come into contact with the no-hang net. Players who can jump to this level would obviously choose to grab the hoop itself rather than the net material. Younger or less gifted players would be unable to reach the no-hang net and hang therefrom, thereby eliminating potential injury and damage.

It is to be understood that the present invention is not limited to the sole embodiment described above, but encompasses any and all embodiments within the scope of the following claims.

I claim:

1. A basketball goal comprising:

a conventional, standard-sized basketball backboard;

a conventional, standard-sized basketball circular hoop structure attached to said backboard;

a horizontal geometric plane defined and enclosed by said conventional, standard-sized circular hoop structure;

a net structure, said net structure attached to said conventional, standard-sized basketball circular hoop structure and positioned substantially within said horizontal plane, said net structure depending no more than one and one-half inches below said horizontal geometric plane;

said net structure being fabricated from an array of outer cords having first ends and second ends;

an inner cord having a periphery and defining a circular opening in said net structure, said first ends of said array outer cords attached to said inner cord around said periphery, wherein said second ends of said array of outer cords are attached to said circular hoop structure; and said circular opening defined by said inner cord has a diameter of approximately eight inches and is adapted to expand to permit a standard sized basketball to pass therethrough.

2. A basketball goal as recited in claim 1, wherein said inner cord is fabricated from elastic material.

3. A basketball goal as recited in claim 2, wherein said array of outer cords is fabricated from a mixture of elastic and non-elastic material.

* * * * *